US006460228B1

(12) United States Patent
Li

(10) Patent No.: US 6,460,228 B1
(45) Date of Patent: Oct. 8, 2002

(54) MONOFILAMENT INTERLACED LOOP SURFACED AND THIN-PROFILE FASTENER STRIP BASE MATERIAL

(76) Inventor: Ling-Mei Li, No. 1-11, Nong 80, Lane Guan-Yin, Hus-Tarn Hsiang Chang-Hua Hsien (TW)

( * ) Notice: Subject to any disclaimer, the term of this patent is extended or adjusted under 35 U.S.C. 154(b) by 0 days.

(21) Appl. No.: 09/901,642

(22) Filed: Jul. 11, 2001

(51) Int. Cl.[7] ..... A44B 18/00

(52) U.S. Cl. ..... 24/445; 24/444; 24/446; 24/449

(58) Field of Search ..... 24/444, 445, 446, 24/449

(56) References Cited

U.S. PATENT DOCUMENTS

| | | | | | |
|---|---|---|---|---|---|
| 3,083,737 | A | * | 4/1963 | De Mestral | 24/445 |
| 3,577,607 | A | * | 5/1971 | Ikoma | 24/445 |
| 3,748,701 | A | * | 7/1973 | De Mestral | 24/445 |
| 4,776,068 | A | * | 10/1988 | Smirlock et al. | 24/444 |
| 5,656,351 | A | * | 8/1997 | Donaruma | 428/97 |
| 5,745,961 | A | * | 5/1998 | Okawa et al. | 24/446 |

* cited by examiner

*Primary Examiner*—Victor Sakran

(74) *Attorney, Agent, or Firm*—Troxell Law Office PLLC

(57) ABSTRACT

A monofilament interlaced loop surfaced and thin-profile fastener strip base material that replaces the multifilar nap surfaced and thicker profiled conventional base material and is fabricated into a unitary structural entity by a knitting machine. Among the innovative features are the interlacing of the upper and lower section wraps of the woof elements to form a bottom weave with a woof-oriented nylon monofilament, the overlaps of which continuously bind a pair of adjacent wraps and thereafter skips the next pair of adjacent wraps in an alternating pattern, the vertical linear interlinking of the overlaps by the continuous binding then becoming the wharf element of the bottom weave. The sections of monofilament that are not utilized for binding densely distributed along the bottom weave surface become arch-shaped freestanding loops that are flat and narrow and have an optimal degree of fastening strength and, furthermore, minimal lean propensity. After the bottom weave undergoes bonding and shaping, the monofilament fastening surface formed by the arch-shaped freestanding loops provides for the engagement of the hook ends along the bottom side of a male fastener strip to the completed bottom weave to thereby achieve conjoinment, with the base material thickness and space occupancy significantly lowered to an ultra-thin dimension. Other practical advantages include the absence of nap displacement, low noise unfastening operation, and width variability.

3 Claims, 5 Drawing Sheets

FIG. 3
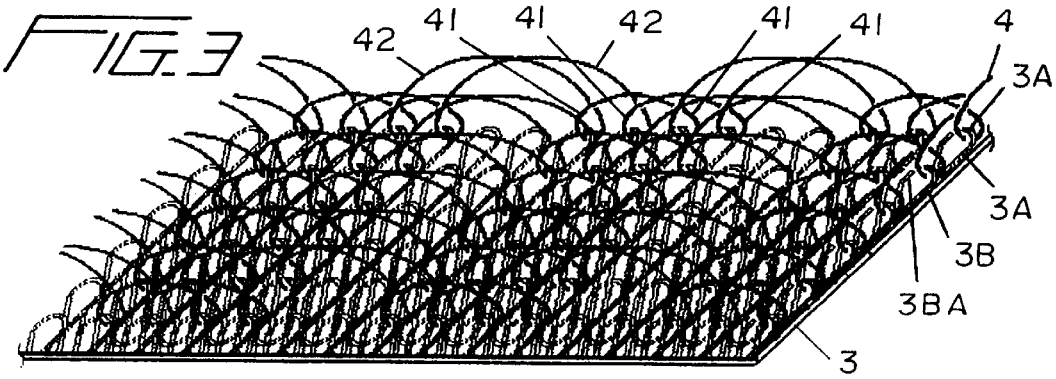
FIG. 3A
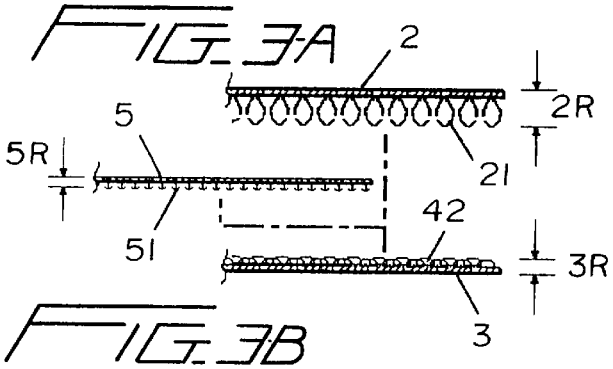
FIG. 1A (PRIOR ART)
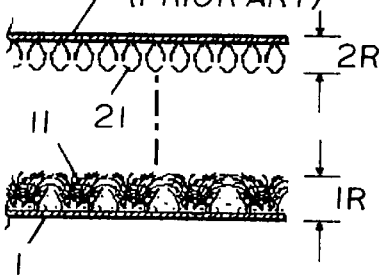
FIG. 3B
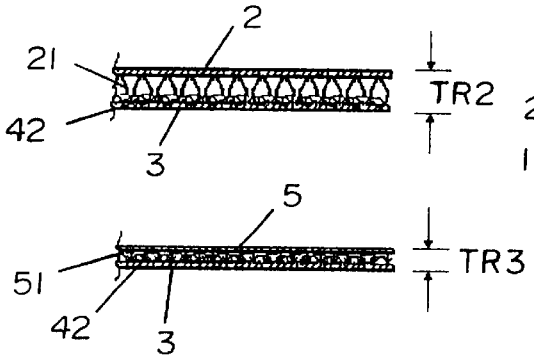
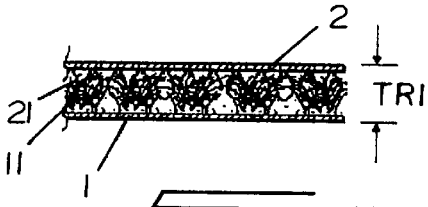
FIG. 1B (PRIOR ART)
FIG. 3C
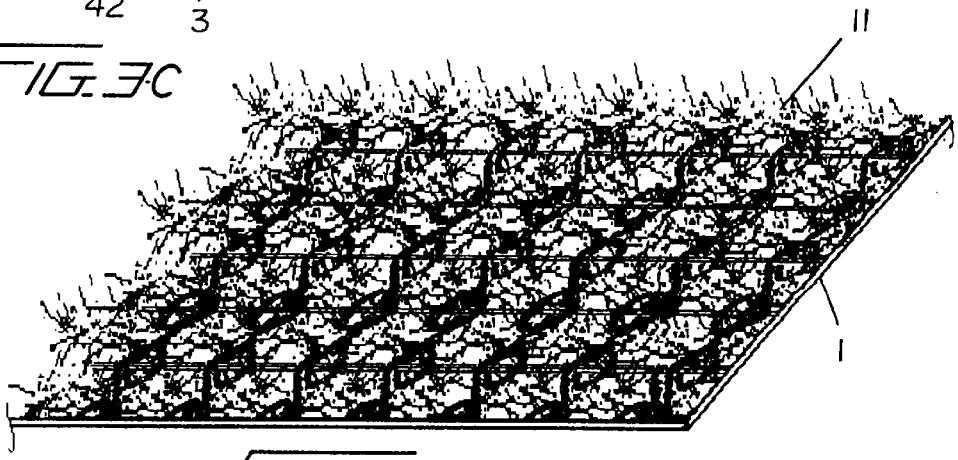
FIG. 1 (PRIOR ART)

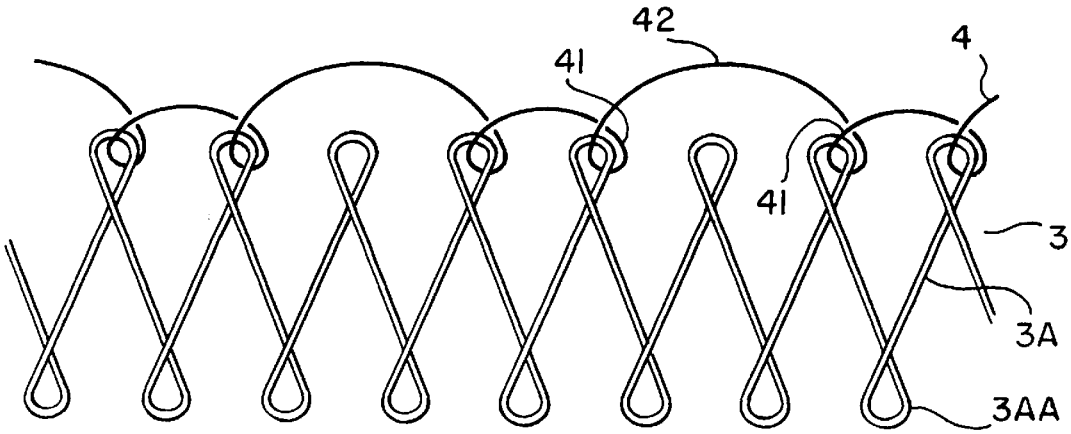
FIG 2-A
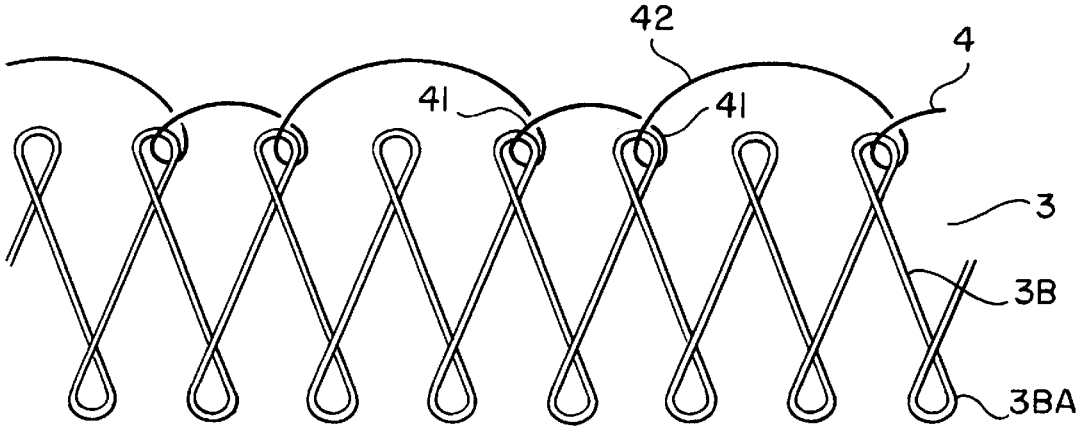
FIG 2-B
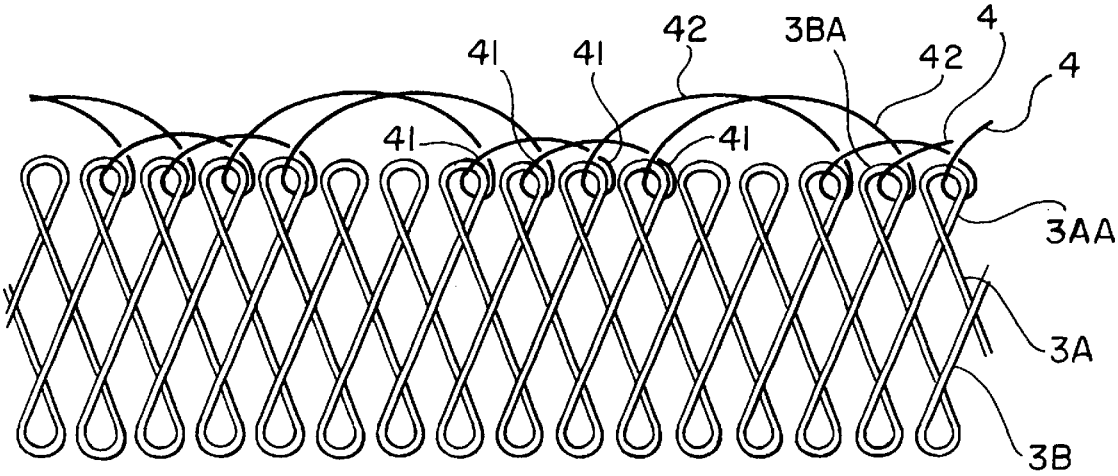
FIG 2-C

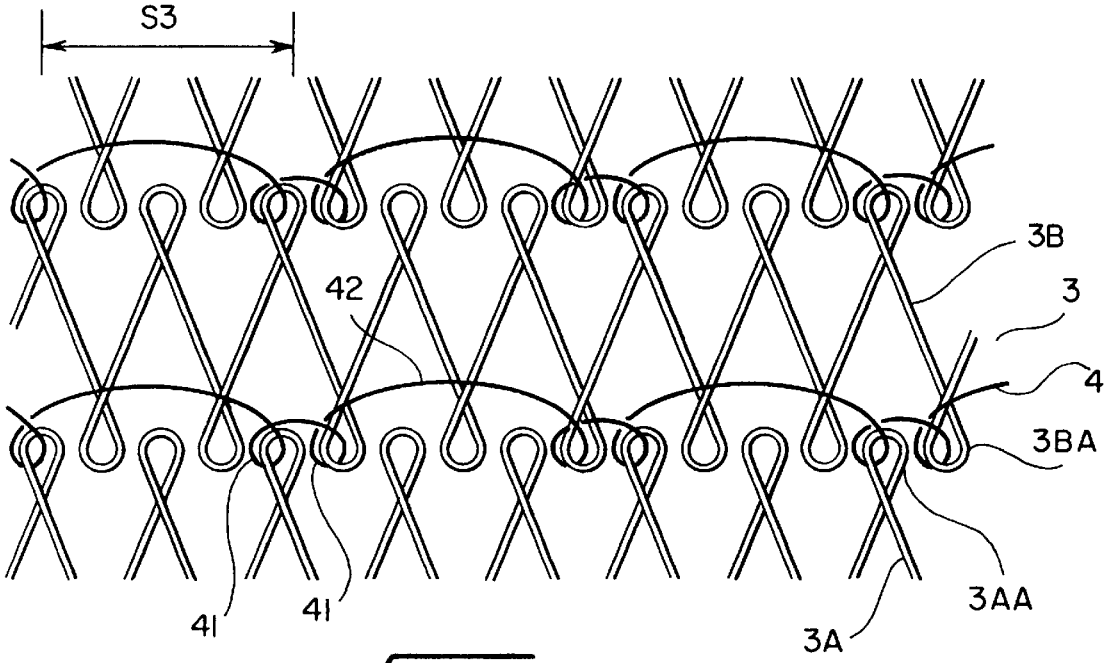
FIG. 4-A
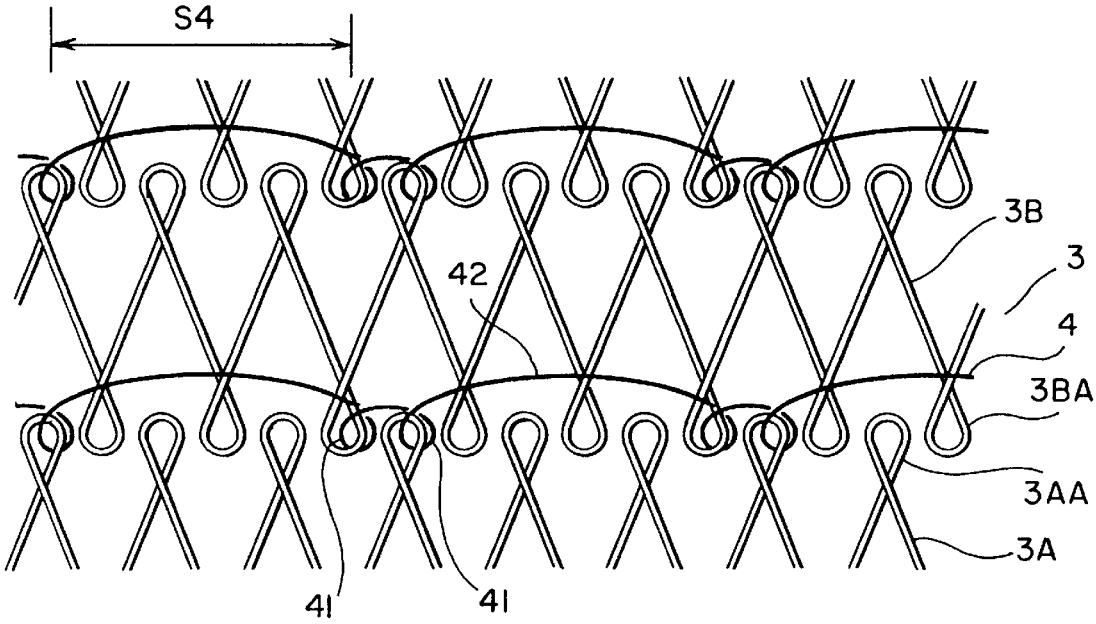
FIG. 4-B

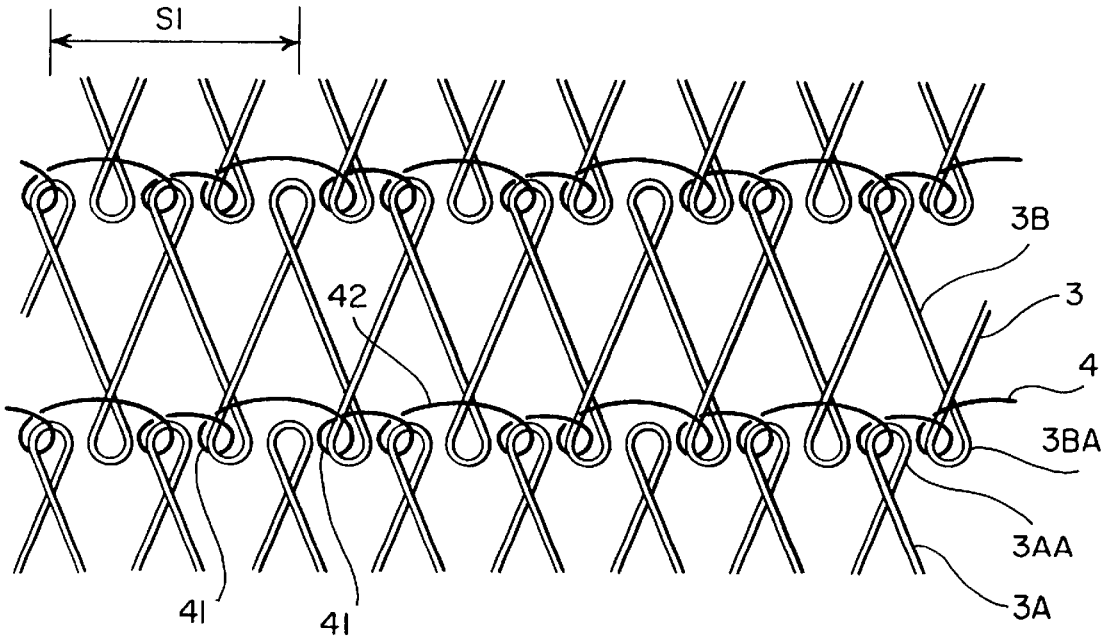
FIG. 4-C
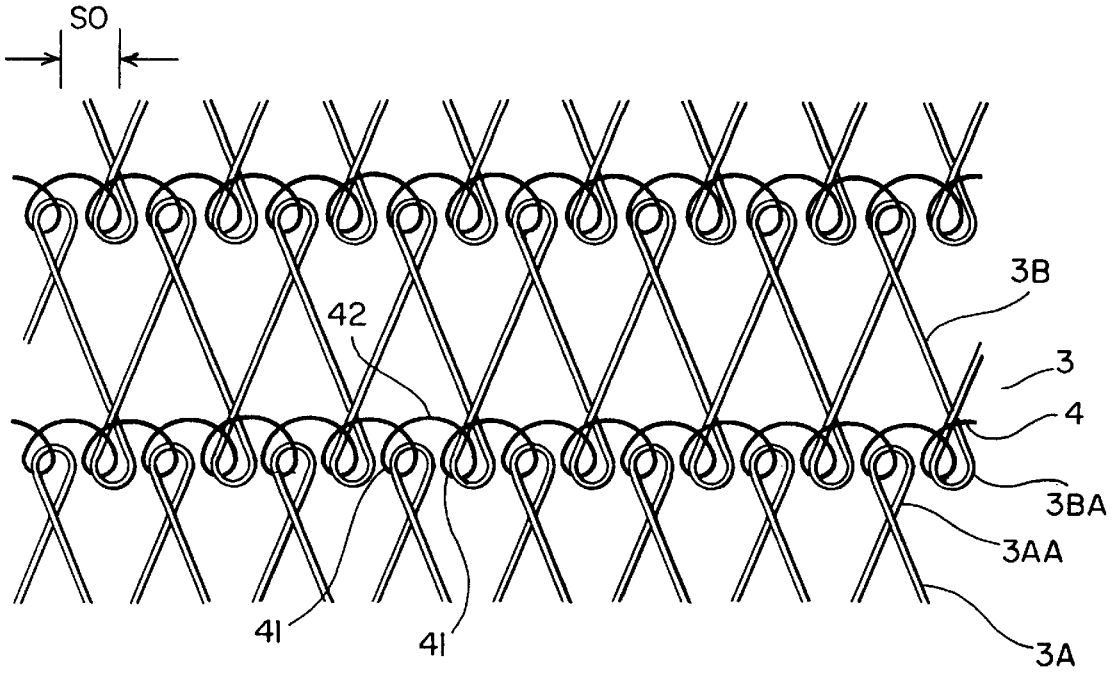
FIG. 4-D

MONOFILAMENT INTERLACED LOOP SURFACED AND THIN-PROFILE FASTENER STRIP BASE MATERIAL

BACKGROUND OF THE INVENTION

1) Field of the Invention

The invention herein relates to a monofilament interlaced loop surfaced and thin-profile fastener strip base material that is fabricated into a unitary structural entity by a knitting machine, the innovative features of which includes the interlacing of the upper and lower section wraps of the woof elements to form a bottom weave with a woof-oriented nylon monofilament, the overlaps of which continuously bind a pair of adjacent wraps and thereafter skips the next pair of adjacent wraps in an alternating pattern; the vertical linear interlinking of the overlaps by the said continuous binding then becomes the warf element of the bottom weave; the sections of monofilament that are not utilized for binding densely distributed along the bottom weave surface become arch-shaped freestanding loops that are flat and narrow and have an optimal degree of fastening strength and, furthermore, minimal lean propensity; as such, after the bottom weave undergoes bonding and shaping processes, the monofilament fastening surface formed by the said arch-shaped freestanding loops provides for the engagement of the hook ends along the bottom side of a male fastener strip to the bottom weave on the thin-profile base material to thereby achieve conjoinment.

2) Description of the Prior Art

Hook and loop fastener strips were invented decades ago and are in widespread usage; since such fastener strips can be attached and conjoined in virtually any arrangement, they typically have fabric bottom layers that are mounted by sewing or adhesion, the closure of the two-sided fastening components providing convenience and other advantages that have enabled them to replace conventional fasteners, zippers, buttons, and so on.

A survey of such products available on the market reveals various patents for improved structure fastener strips or case continuations thereof, the majority of which include a male fastener strip 1 having hook ends 21 distributed along the bottom portion (for the description below, refer to FIG. 1, FIG. 1-A, and FIG. 1-B); the base material 1 (i.e., the female fastener strip) that provides for the engagement of the hook ends 21 is a textured material of distributed multifilar construction that is woven onto the top surface of the base material 1 to thereby produce a very soft, thick nap fastening surface 11.

Since the end portions of the nap fastening surface 11 are essentially raw fibers not secured by knitting or weaving, after the hook ends 21 of the male fastener strip 2 are disengaged, the tearing force of the hook ends 21 readily loosens and pulls out the fibers; in addition to detracting from appearance, the extraction of fibers gradually lessens the degree of fastening strength between the male fastener strip 2 and the base material 1.

Furthermore, the piled sponge-like characteristics of the nap fastening surface 11 causes the thickness of the said base material to reach approximately 2.5 mm (as indicated by the measurement 2R in FIG. 1-A); if the approximately 2.0 mm thickness (as indicated by the measurement 1R in FIG. 1-A) of a conventional male fastener strip 2 is added, the total thickness following closure is approximately 3.5 mm (as indicated by the measurement TR1 in FIG. 1-B, wherein the hook end 21 portions penetrating into and engaging the nap fastening surface 11 results in a slight reduction in the actual combined thickness of the two). As such, in general applications of such conventional fastener strips on apparel and other articles requiring fasteners, the serious shortcomings include the unavoidable forming of a discontinuity (of approximately 3.5 mm) along the area of closure that ruins appearance; moreover, the relatively lengthy hook ends 21 penetrating into and engaging the disarrayed fibers of the nap fastening surface 11 are such that when the male fastener strip 2 and the base material 1 are pulled apart during the unfastening operation, an ear shattering tearing sound is generated and, furthermore, the larger the square area of the fastening surface, the greater the audible intensity of the tearing, with excessive length also contributing to the discomfort of the user. These are the drawbacks of a fastener strip base material 1 utilizing a multifilar-construction nap fastening surface 11 and it is believed that they are among the main reasons why discontinuing the use of convenient fastener strips on some high-end apparel and products requiring fasteners has been considered.

Moreover, commercially available fastener strip base materials at present are confined to a specialized narrow range of textile structures, with the width of the base material products limiting them to belt-like and strip-like arrangements, which once again further restricts utility and applications.

SUMMARY OF THE INVENTION

The primary objective of the invention herein consists of interlacing the upper and lower section wraps of the woof elements to form a bottom weave with a woof-oriented nylon monofilament, the overlaps of which continuously bind a pair of adjacent wraps and thereafter skips the next pair of adjacent wraps in an alternating pattern; the vertical linear interlinking of the overlaps by the said continuous binding then becomes the warf element of the bottom weave; the sections of monofilament that are not utilized for binding densely distributed along the bottom weave surface become arch-shaped freestanding loops that are flat and narrow and have an optimal degree of fastening strength and, furthermore, minimal lean propensity; as such, after the bottom weave undergoes bonding and shaping processes, the monofilament fastening surface formed by the said arch-shaped freestanding loops provides for the engagement of the hook ends along the bottom side of a male fastener strip, with the thickness of the ultra-thin base material of the present invention reduced to approximately two-thirds that of a conventional base material, thereby decreasing the combined thickness and space occupancy of the base material and the male plastic fastener strip when conjoined during usage as well as lessening the discontinuity left between the two fastening components to a bare minimum, thereby effectively broadening the practical range of fastener strip applications, which is among the innovative features of the present invention.

Another objective of the invention herein consists of the arch-shaped freestanding loops that are flat and narrow and, furthermore, have minimal lean propensity, which by means of continuous overlaps and binding are tightly and securely interlinked to the bottom weave warf element; therefore, this provides the necessary degree of fastening strength when a male fastener strip is conjoined and, furthermore, optimal durability because separating the male fastener strip does not result in filar displacement.

Yet another objective of the invention herein consists of the arch-shaped freestanding loops that are flat and narrow and, furthermore, have minimal lean propensity, which when conjoined to the male fastener strip allows the hook ends along the bottom side to become engaged in a shallow arrangement without affecting the degree of fastening strength, thereby providing excellent practicality by facilitating separation from the base material of the present invention and reducing the noise of the unfastening operation.

Still another objective of the invention herein consists of the said flat and narrow arch-shaped freestanding loops, which provide for usage with short hook ends of the male fastener strip to further reduce the combined thickness and space occupancy of the base material and the male fastener strip when conjoined during usage and thereby further encouraging virtually unlimited fastener strip applications.

A further objective of the invention herein consists of the said flat and narrow arch-shaped freestanding loops, wherein the overlaps of the woof-oriented nylon monofilament continuously bind a pair of adjacent wraps and thereafter skips the next pair of adjacent wraps in an alternating pattern provide for the variable control of freestanding loop length and thereby effectively allows convenient control over the degree of fastening strength (the greater the freestanding loop length, the higher the degree of strength; the shorter the freestanding loop length, the lower the degree of strength), thereby enabling convenient and rapid fabrication that meets the specific requirement of fastener strips based on the intended applications.

Another objective of the invention herein is the selective determination of the arch-shaped freestanding loop length during the fabrication process that allows control over the degree of fastening strength without requiring different types of male fastener strips and hook ends, thereby facilitating practical and economical production.

Yet another objective of the invention herein consists of allowing the base material to be constructed at extreme widths to accommodate general fabric surfaces and, as such, utilization is not limited to design by trimming and thereby widens the scope of fastener strip application, which is among the innovative features of the invention herein.

The structural features, operation, and other particulars of the invention here are fisher elaborated in the brief description of the drawings below and followed by the detailed description of the invention

BRIEF DESCRIPTION OF THE DRAWINGS

FIG. 1 is an isometric drawing of a conventional base material .

FIG. 1-A is an orthographic drawing that illustrates the placement of the conventional male fastener strip and base material.

FIG. 1-B is an orthographic drawing that illustrates the engagement of the conventional male fastener strip with the base material.

FIG. 2-A is an orthographic drawing of the first weave of the base material of the invention herein, as viewed from a lateral perspective.

FIG. 2-B is an orthographic drawing of the second weave of the base material of the invention herein, as viewed from a lateral perspective.

FIG. 2-C is an orthographic drawing of two weaves in proximity following conjoinment, as viewed from a lateral perspective.

FIG. 3 is an isometric drawing of the base material of the invention herein.

FIG. 3-A is an orthographic drawing that illustrates the placement of the conventional male fastener strip and the thin-profile male fastener strip of the present invention relative to the base material of the invention herein.

FIG. 3-B is an orthographic drawing that illustrates the conjoinment of the base material of the invention herein to the conventional male fastener strip.

FIG. 3-C is an orthographic drawing that illustrates the conjoinment of the base material and the thin-profile male fastener strip of the invention herein.

FIG. 4-A is an orthographic drawing of a long arch-shaped freestanding loop weave of the invention herein.

FIG. 4-B is an orthographic drawing of an even longer arch-shaped freestanding loop weave of the invention herein.

FIG. 4-C is an orthographic drawing of a relatively short arch-shaped freestanding loop weave of the invention herein.

FIG. 4-D is an orthographic drawing of the shortest arch-shaped freestanding loop weave of the invention herein.

DETAILED DESCRIPTION OF THE INVENTION

Figure 2:
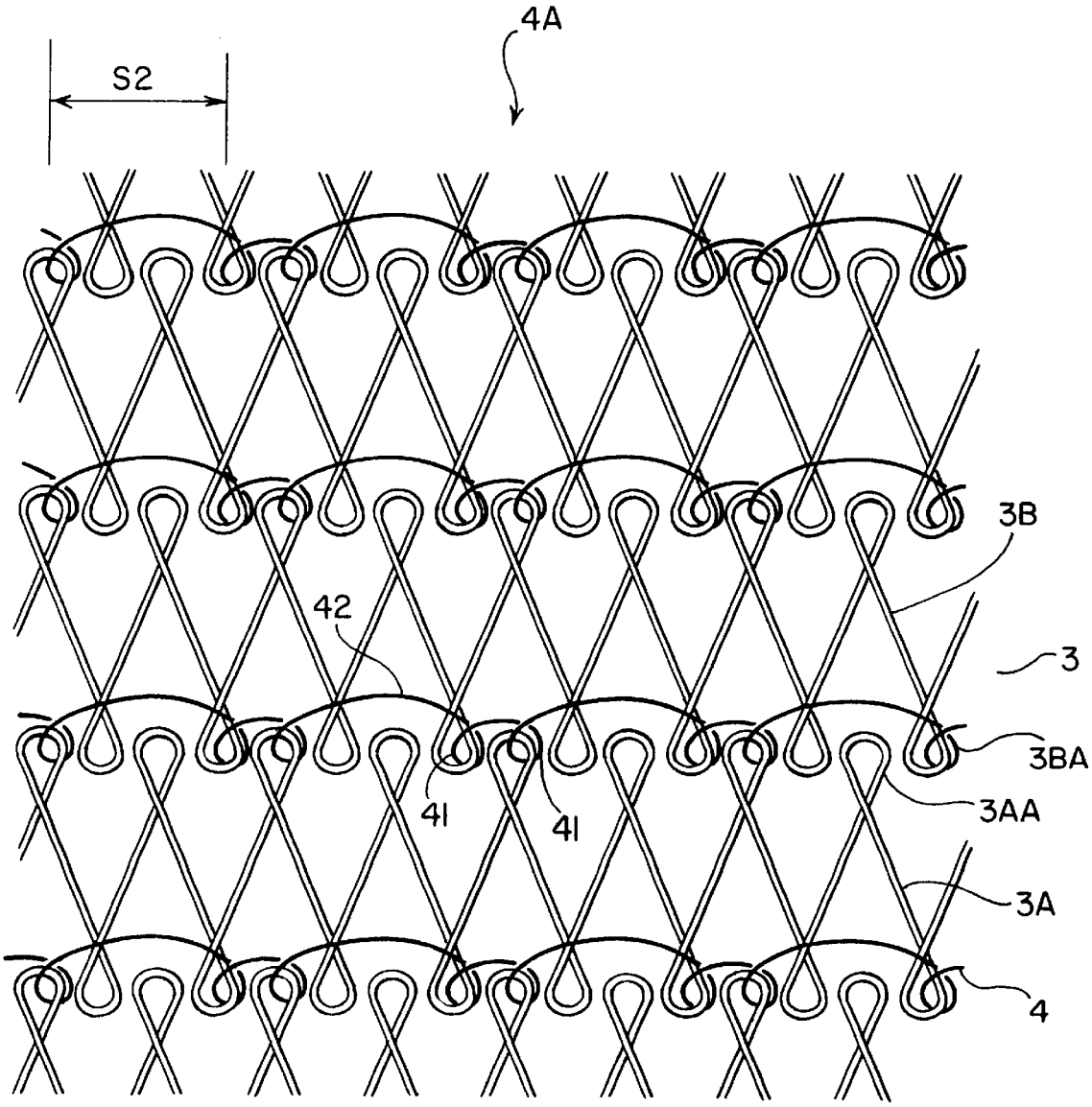
FIG. 2 is an orthographic drawing of the base material weave of the invention.

Referring to FIG. 2, the thin-profile base material 3 of the invention herein replaces the multifilar nap surfaced and thicker profiled conventional base material (i.e., the base material 1 shown in FIG. 1) and is fabricated into a unitary structural entity by a knitting machine, the innovative features of which are:

The upper and lower section wraps 3AA and 3BA of the woof (horizontally oriented) elements 3A and 3B are interlaced to form a bottom weave 3 and consists of a woof-oriented nylon monofilament 4, the overlaps 41 of which continuously bind a pair of adjacent wraps 3AA and 3BA and thereafter skips the next pair of adjacent wraps 3AA and 3BA in an alternating pattern; the linear interlinking of the overlaps 41 by the said continuous binding then becomes the warf element (the vertically oriented series of overlaps 41 indicated by the arrow 4A in FIG. 2) of the bottom weave 3; the sections of monofilament 4 that are not utilized for binding densely distributed along the bottom weave 3 surface become arch-shaped freestanding loops 42 that are flat and narrow and have an optimal degree of fastening strength and, furthermore, minimal lean propensity.

After the bottom weave 3 undergoes bonding and shaping processes, the monofilament 4 fastening surface (as shown in FIG. 3) formed by the said arch-shaped freestanding loops 42 provides for the engagement of the hook ends 21 along the bottom side of a male fastener strip 2 to the completed bottom weave 3 (as shown in FIG. 3-A) to thereby achieve conjoinment; in addition, since the arch-shaped freestanding loops 42 are distributed in a uniformly flat arrangement on the bottom weave 3 surface, the base material 1 thickness and space occupancy is significantly lowered, effectively reducing the total thickness of the bottom weave 3 to an ultra-thin dimension of approximately 0.8 mm (as indicated by the measurement 3R in FIG. 3-A) that is considerably thinner than a conventional base material (not even one-third of its total thickness).

When a conventional male fastener strip 2 of approximately 2.0 mm in height is utilized, the height after conjoinment is approximately 2.5 mm (as indicated by the measurement TR2 in FIG. 3-B, wherein the hook end 21 portions penetrating into and engaging the arch-shaped freestanding loops 42 results in a slight reduction in the actual combined thickness of the two).

Furthermore, a thin plastic male fastener strip 5 (having a thickness of approximately 0.8 mm, the same as that of the base material 3 of the present invention; as indicated by the measurement 5R in FIG. 3-A) formed with short hook ends 51 was introduced to the market in recent years; it can be utilized with the base material 3 of the invention herein to further reduce the combined thickness and space occupancy of the base material 3 and the plastic male fastener strip 1 when conjoined during usage (their total conjoined thickness is approximately 1.2 mm; as indicated by the measurement TR3 in FIG. 3-B); by utilizing these, the discontinuity that is left between the two fastening components is reduced to a bare minimum. As such, this clearly enhances applications appearance and further promotes the utilization of fastening strips on apparel and ornamental articles, which is the major utilization benefit of the invention herein.

In addition, as indicated in FIG. 2, the bottom weave 3 of the invention herein is constructed by articulating nylon monofilament 4 overlaps 41 to continuously bind a pair of adjacent wraps 3AA and 3BA and thereafter skip the next pair of adjacent wraps 3AA and 3BA in an alternating pattern, the vertical linear interlinking of the overlaps 41 by the said continuous binding then becoming the warf element, as thereby constructed, the two courses of wraps 3AA and 3BA that are not binded in between provides for arch-shaped freestanding loops 42 (indicated by the length S2 in FIG. 2) of medium length and fastening strength for conjoinment to the male fastener strip 2/5.

Regarding different degrees of fastening strength, if it is necessary to increase fastening strength, the articulating of longer arch-shaped freestanding loops 42 is an option, wherein each arch-shaped freestanding loop 42 is separated by three courses of non-binded adjacent wraps 3AA (3BA) to form arch-shaped freestanding loops 42 of greater length (as indicated by the length S3 in FIG. 4-A) or each arch-shaped freestanding loop 42 is separated by four courses of non-binded adjacent wraps 3AA (3BA) to form arch-shaped freestanding loops 42 of even greater length (as indicated by the length S4 in FIG. 4-B); fastening strength is thus directly proportional to the quantity of non-binded adjacent wraps 3AA (3BA), with a higher quantity increasing the degree of fastening strength (however, it should be explained that an excessive quantity of non-binded adjacent wraps 3AA and 3BA will yield less than optimal results in that there will be a loss of self-erecting properties in the arch-shaped freestanding loops 42).

If it is necessary to decrease the degree of fastening strength, the option is the articulating of shorter arch-shaped freestanding loops 42, wherein each arch-shaped freestanding loop 42 is separated by one pair of non-binded adjacent wraps 3AA (3BA) to form arch-shaped freestanding loops 42 of shortened length (as indicated by the length S1 in FIG. 4-C) or each arch-shaped freestanding loop 42 remains unseparated by any non-binded adjacent wraps 3AA (3BA) by an uninterrupted series of overlaps 41 to thereby form the shortest arch-shaped freestanding loops 42 (as indicated by the length SO in FIG. 4-D) and, as such, provide for a fastener strip having lower fastening strength.

In summation of the foregoing section, the selective determination of arch-shaped freestanding loop 42 length during the fabrication process affords control over the degree of fastening strength built into the fastener strips without requiring different types of male fastener strips 2/5 and hook ends 21/51; this is an advantage that cannot be integrated into conventional fastener strip base materials and is incomparable in terms of facilitating production efficiency.

What is claimed is:

1. A monofilament interlaced loop surfaced and thin-profile fastener strip base material that is fabricated into a unitary structural entity by a knitting machine, the innovative features of which are:

The upper and lower section wraps of the woof elements are interlaced to form a bottom weave and consists of a woof-oriented monofilament, the overlaps of which continuously bind a pair of adjacent wraps and thereafter skips the next pair of adjacent wraps in an alternating pattern; the vertical linear interlinking of the said overlaps by the said continuous binding then becomes the wharf element of the said bottom weave; the sections of said monofilament that are not utilized for binding densely distributed along the said bottom weave surface become arch-shaped freestanding loops that are flat and narrow and have an optimal degree of fastening strength and, furthermore, minimal lean propensity, the thin-profile structure thereby providing for the engagement of hook ends along the bottom side of a male fastener strip to the base material (female fastener strip) to thereby achieve conjoinment.

2. As mentioned in claim 1 of the monofilament interlaced loop surfaced and thin-profile fastener strip base material of the invention herein, the said monofilament, the said overlaps of which are articulated to continuously bind a pair of adjacent said wraps and skip the next pair of adjacent said wraps in an alternating pattern, is optimally constructed of a nylon material.

3. As mentioned in claim 1 of the monofilament interlaced loop surfaced and thin-profile fastener strip base material of the invention herein, after the said overlaps are articulated to continuously bind a pair of adjacent said wraps, the quantity of non-binded adjacent said wraps skipped immediately thereafter can be controllably increased or decreased, thereby allowing the selective determination of the said arch-shaped freestanding loop length during the fabrication process that affords control over the degree of fastening strength built into the fastener strips.

* * * * *